US011460250B2

(12) United States Patent
Hortop

(10) Patent No.: US 11,460,250 B2
(45) Date of Patent: Oct. 4, 2022

(54) DRYER ATTACHMENT FOR A VEHICLE

(71) Applicant: Rivian IP Holdings, LLC, Plymouth, MI (US)

(72) Inventor: Matthew Hortop, Livonia, MI (US)

(73) Assignee: Rivian IP Holdings, LLC, Irvine, CA (US)

( * ) Notice: Subject to any disclaimer, the term of this patent is extended or adjusted under 35 U.S.C. 154(b) by 2 days.

(21) Appl. No.: 16/917,312

(22) Filed: Jun. 30, 2020

(65) Prior Publication Data

US 2021/0404744 A1 Dec. 30, 2021

(51) Int. Cl.
*F26B 25/06* (2006.01)

(52) U.S. Cl.
CPC ..... *F26B 25/063* (2013.01)

(58) Field of Classification Search
CPC ..... F26B 25/063
USPC ..... 34/90
See application file for complete search history.

(56) References Cited

U.S. PATENT DOCUMENTS 2,718,069 A * 9/1955 Nofziger ..... F26B 25/063 34/232
5,370,576 A * 12/1994 Krofchalk ..... B60H 1/00464 454/143
5,732,764 A * 3/1998 Douglas ..... B60H 1/00014 126/19.5
6,018,885 A * 2/2000 Hill ..... F26B 9/06 34/202
6,843,717 B1 * 1/2005 Bennett ..... B60H 1/00564 128/200.27
7,273,154 B1 * 9/2007 Edwards ..... D06F 53/02 211/119.01
7,410,415 B2 * 8/2008 Ronnlund ..... B62D 33/06 454/162
7,437,883 B1 * 10/2008 Baidal ..... B60H 1/00564 62/259.3
7,871,318 B2 * 1/2011 Williams ..... B60H 1/345 454/155
9,200,834 B1 * 12/2015 Ball, Jr. ..... F26B 21/022
(Continued)

FOREIGN PATENT DOCUMENTS

CN 1 04 210 402 A 12/2014
JP S63 201 811 U 12/1988
JP H078117 U 2/1995

OTHER PUBLICATIONS

Nov. 16, 2021, German Office Action issued in International Application No. 10 2021 204 595.2.

*Primary Examiner* — Stephen M Gravini
(74) *Attorney, Agent, or Firm* — Clements Bernard Baratta; Christopher L. Bernard

(57) ABSTRACT

A dryer attachment for a vehicle, including: a coupler adapted to engage a heating, ventilation, and air conditioning (HVAC) duct of the vehicle; a flexible conduit coupled to the coupler; and a nozzle coupled to the flexible conduit opposite the coupler; wherein the coupler, the flexible conduit, and the nozzle are collectively adapted to deliver an air flow from the HVAC duct of the vehicle to an object disposed adjacent to a port of the nozzle. The coupler is adapted to engage a vent of the HVAC duct of the vehicle. Alternatively, the coupler is adapted to replace a vent of the HVAC duct of the vehicle. Alternatively, the coupler is adapted to engage a dedicated port of the HVAC duct of the vehicle.

20 Claims, 4 Drawing Sheets

(56) References Cited

U.S. PATENT DOCUMENTS

| | | | | |
|---|---|---|---|---|
| 10,752,084 | B2 * | 8/2020 | Thodeme | B60H 1/008 |
| 2013/0318814 | A1 * | 12/2013 | Anikin | F26B 25/16 34/487 |

* cited by examiner

DRYER ATTACHMENT FOR A VEHICLE

INTRODUCTION

The present disclosure relates generally to the automotive and electric vehicle (EV) fields. More particularly, the present disclosure relates to a dryer attachment for a vehicle.

When using vehicles for outdoor adventures and the like, a conventional hairdryer plugged into a 120V inverter is popular for the drying of hair, clothes, and people in general. Such inverters are bulky and must be installed directly to a battery of a vehicle. This takes up space, including component space and cargo space, in the vehicle. Making an inverter a built-in fixture increases the risk of draining the battery, and it is preferred that a vehicle is operating and a user is present during a drying operation.

In EVs, the electric heater utilized in the heating, ventilation, and air conditioning (HVAC) system is much more powerful than a conventional plug-in hairdryer, and operates without running a noisy and dirty internal combustion (IC) engine. Such electric heaters, however, are not currently fully utilized.

It will be readily apparent to those or ordinary skill in the art that this introduction is provided as helpful context and environment only, and that the concepts associated with the deployable bed cover and deployment method of the present disclosure may be implemented in other contexts and environments equally.

BRIEF SUMMARY

In one illustrative embodiment, the present disclosure provides a dryer attachment for a vehicle, including: a coupler adapted to engage a heating, ventilation, and air conditioning (HVAC) duct of the vehicle; a flexible conduit coupled to the coupler; and a nozzle coupled to the flexible conduit opposite the coupler; wherein the coupler, the flexible conduit, and the nozzle are collectively adapted to deliver an air flow from the HVAC duct of the vehicle to an object disposed adjacent to a port of the nozzle. The coupler is adapted to engage a vent of the HVAC duct of the vehicle. Alternatively, the coupler is adapted to replace a vent of the HVAC duct of the vehicle. Alternatively, the coupler is adapted to engage a dedicated port of the HVAC duct of the vehicle.

In another illustrative embodiment, the present disclosure provides a method for drying an object in a vehicle, including: attaching a dryer attachment to a heating, ventilation, and air conditioning (HVAC) duct of the vehicle, wherein the dryer attachment includes: a coupler adapted to engage the HVAC duct of the vehicle; a flexible conduit coupled to the coupler; and a nozzle coupled to the flexible conduit opposite the coupler; wherein the coupler, the flexible conduit, and the nozzle are collectively adapted to deliver an air flow from the HVAC duct of the vehicle to an object disposed adjacent to a port of the nozzle; and enabling the air flow from the HVAC duct of the vehicle to the object disposed adjacent to the port of the nozzle. Enabling the air flow from the HVAC duct of the vehicle to the object disposed adjacent to the port of the nozzle includes opening a baffle of the HVAC duct of the vehicle adjacent to the coupler. Optionally, the method further includes disabling another air flow from the HVAC duct of the vehicle. Disabling the other air flow from the HVAC duct of the vehicle includes closing a baffle of the HVAC duct of the vehicle remote from the coupler. Attaching the dryer attachment to the HVAC duct of the vehicle includes attaching the coupler to a vent of the HVAC duct of the vehicle. Alternatively, attaching the dryer attachment to the HVAC duct of the vehicle includes replacing a vent of the HVAC duct of the vehicle with the coupler. Alternatively, attaching the dryer attachment to the HVAC duct of the vehicle includes attaching the coupler to a dedicated port of the HVAC duct of the vehicle.

The foregoing brief summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Illustrative embodiments are illustrated in referenced figures of the drawings. It is intended that the embodiments and figures disclosed herein are to be considered illustrative rather than restrictive.

DETAILED DESCRIPTION

Figure 1:
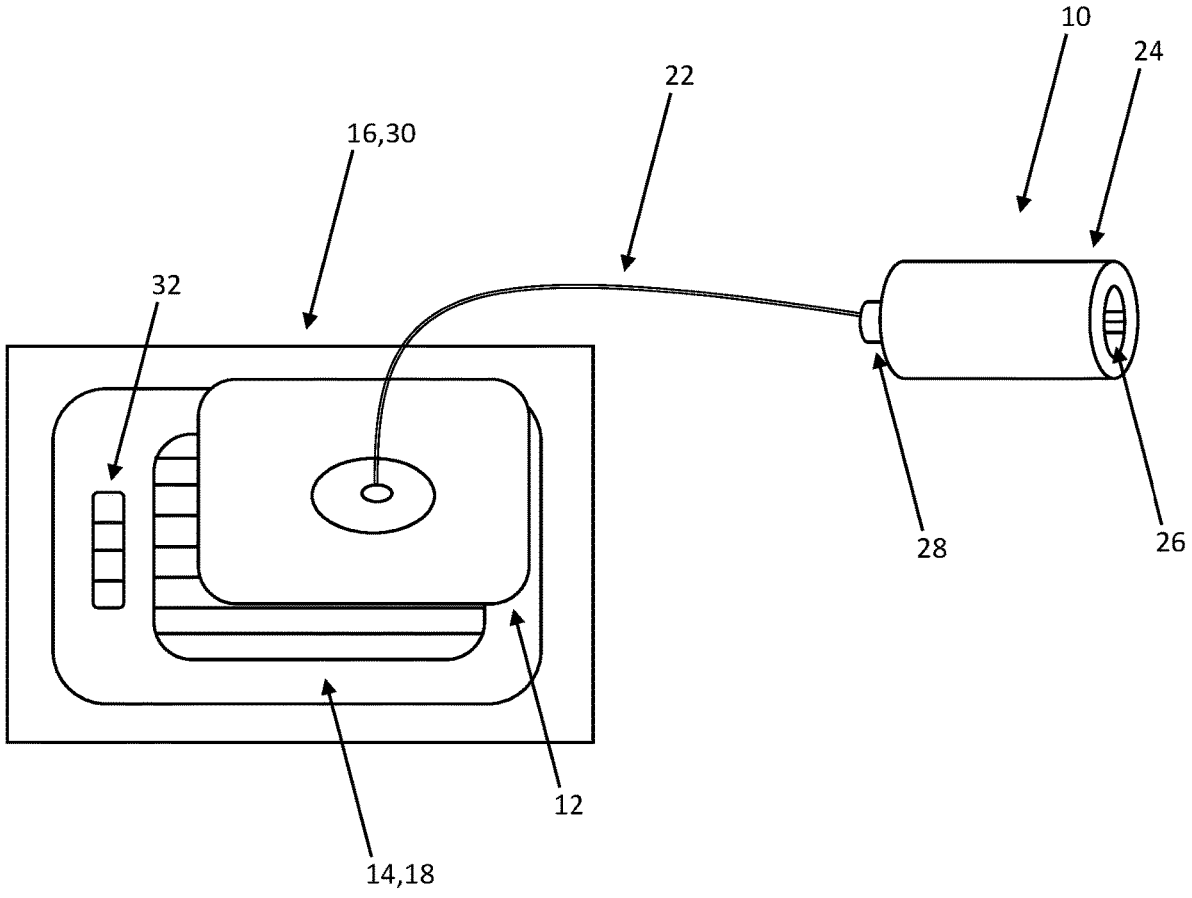
FIG. 1 is a schematic diagram illustrating one illustrative embodiment of the dryer attachment of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The present disclosure provides a dryer attachment for a vehicle that replaces a conventional plug-in hairdryer and makes use of the electric heater and HVAC duct network of the vehicle. As mentioned herein above, the electric heater utilized in the HVAC system is much more powerful than a conventional plug-in hairdryer, and operates without running a noisy and dirty IC engine. The electric heater may be set to operate for a predetermined period of time, without the vehicle otherwise operating or being drivable, thus allowing a user to go away while an object is dried, for example.

The HVAC heater/cooler and duct work of the vehicle itself are used to provide a forced air flow to an attached nozzle. A coupler plugs into or replaces a vent disposed within the interior (or on the exterior) of the vehicle, or plugs into a dedicated interior or exterior port that is in fluid communication with an HVAC duct and, ultimately the HVAC heater/cooler and associated blower. Any length of flexible (or partially flexible) conduit or hosing can be used and direct the air flow to the nozzle as needed. The HVAC system is selectively controlled to direct air flow only to a vent/port used, or may be simultaneously directed to all vents/ports to maintain overall vehicle comfort while the dryer attachment is being used. Further a rack or other support structure can be provided in or adjacent to the vehicle to hold the nozzle during a drying operation.

FIG. 1 is a schematic diagram illustrating one illustrative embodiment of the dryer attachment 10 of the present disclosure. The dryer attachment 10 includes a coupler 12 that is adapted to engage a HVAC duct 14 of a vehicle 16, either inside or outside the vehicle 16. Specifically, as is described in greater detail herein below, the coupler 12 is adapted to attach to a vent 18 of the HVAC duct 14 (see FIG. 1), replace the vent 18 of the HVAC duct 14 (see FIG. 2), or attach to a dedicated port 20 (FIG. 3) of the HVAC duct 14 (see FIG. 3). The coupler 12 generally includes a prismatic structure or connector that is sized and configured to "snap" onto the vent 18 (see FIG. 1), into the space vacated by the vent 18 (see FIG. 2), or otherwise engage the dedicated port 20 (see FIG. 3), thereby providing a fluid communication channel between the HVAC duct 14 and the dryer attachment 10. The coupler 12 may be manufactured from a polymeric material, a metallic material, or the like. Various latches, retention mechanisms, and/or locking mechanisms may be used to secure the coupler 12 onto the vent 18 (see FIG. 1), into the space vacated by the vent 18 (see FIG. 2), or into/onto the dedicated port 20 (see FIG. 3).

The dryer attachment 10 also includes a flexible conduit 22 coupled to the coupler 12. The flexible conduit 22 consists of a hose and may have any desired length such that the dryer attachment 10 may be used in a desired area inside or outside the vehicle 16, away from the coupler 12 and vent 18 or dedicated port 20. The flexible conduit 22 may be entirely flexible, or include both flexible and rigid portions. The flexible conduit 22 may be manufactured, in whole or in part, from a polymeric material, a metallic material, or the like. For example, the flexible conduit 22 may be a rubber hose, a flexible metallic conduit, an expandable "flex" hose, or the like. Such conduits and hoses are well known to those of ordinary skill in the art. Preferably, the flexible conduit 22 has an internal diameter that is sized to provide a desired air flow from the HVAC duct 14 through the dryer attachment 10, given the length of the flexible conduit 22.

At the end of the flexible conduit 22 is a nozzle 24 coupled to the flexible conduit 22 opposite the coupler 12. The coupler 12, the flexible conduit 22, and the nozzle 24 are collectively adapted to deliver an air flow from the HVAC duct 14 of the vehicle 16 to an object disposed adjacent to a port 26 of the nozzle 24. The flexible conduit 22 is coupled to the nozzle via a fluid tight seal 28, which may be any type of fluid tight seal known to those of ordinary skill in the art. The port 26 of the nozzle 24 may include a simple opening, a multiple openings, a baffled opening, a spray opening, etc. In general, the nozzle 24 may consist of a simple cylindrical structure, or a structure with a tapering inside diameter, such that the velocity of the air flow is increased as it passes through the nozzle 24, or a structure with a tapering inside diameter, such that the velocity of the air flow is decreased as it passes through the nozzle 24. The outside diameter may have any suitable shape, such as a shape that promotes gripping by the user, attachment to another structure, etc. Optionally, the nozzle 24 includes an electric fan that imparts additional velocity to the air flow there through, powered by either a battery pack or a power supply of the vehicle 16 through power cable coincident with the flexible conduit 22 and receptacle coincident with the vent 18 or dedicated port 20. The nozzle 24 may be manufactured from a polymeric material, a metallic material, or the like, and an outer surface thereof may include an appropriate gripping material, for example.

As alluded to herein above, the HVAC duct 14 of the vehicle 16 is coupled to an electric air heater/cooler and blower of an HVAC system of the vehicle 16. This blower imparts velocity to the air flow that is delivered through the dryer attachment 10.

Figure 2:
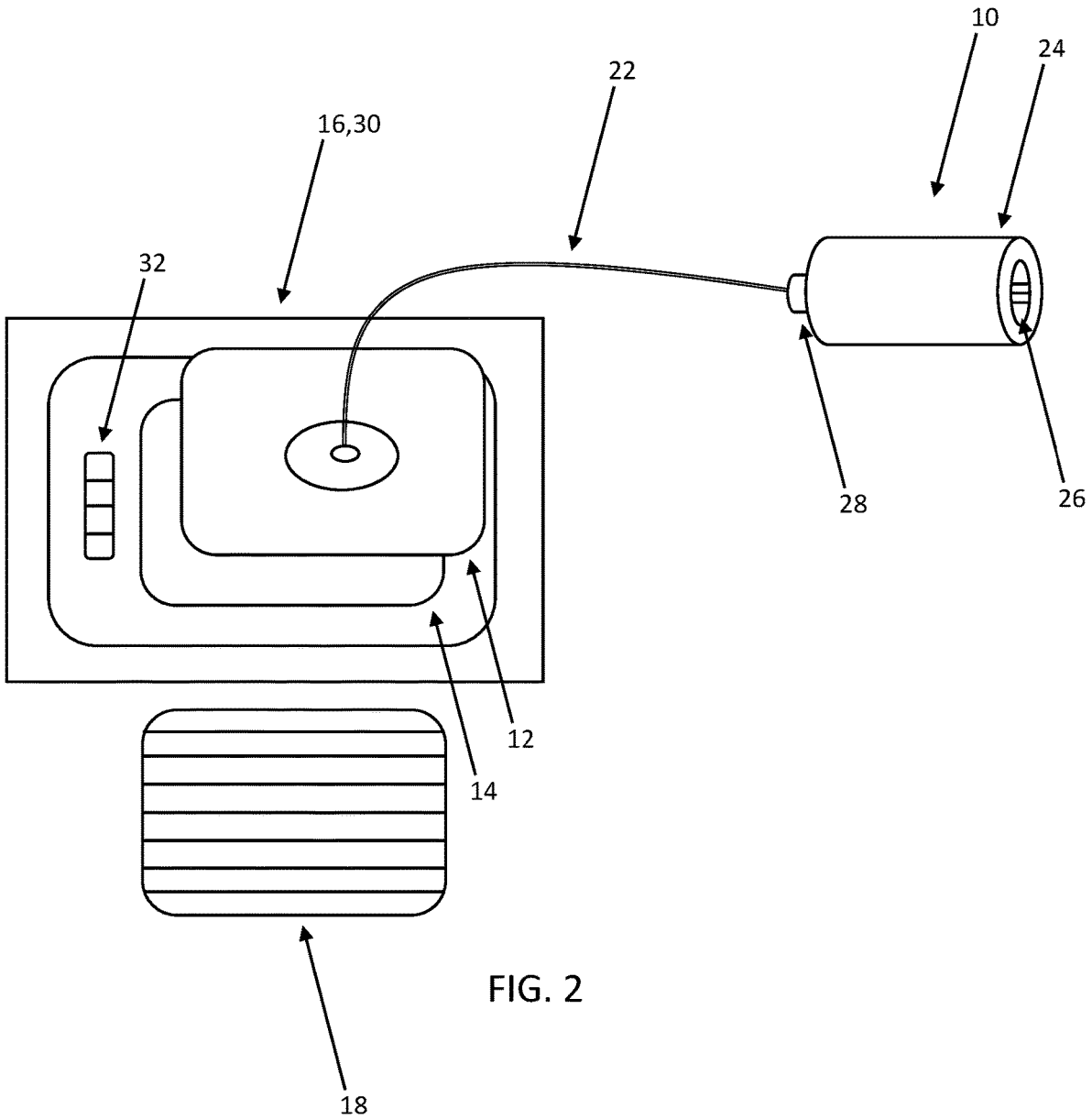
FIG. 2 is a schematic diagram illustrating another illustrative embodiment of the dryer attachment of the present disclosure.

FIG. 2 is a schematic diagram illustrating another illustrative embodiment of the dryer attachment 10 of the present disclosure. The dryer attachment 10 again includes a coupler 12 that is adapted to engage a HVAC duct 14 of a vehicle 16, either inside or outside the vehicle 16. Specifically, as is described in greater detail herein below, the coupler 12 is adapted to attach to a vent 18 of the HVAC duct 14 (see FIG. 1), replace the vent 18 of the HVAC duct 14 (see FIG. 2), or attach to a dedicated port 20 (FIG. 3) of the HVAC duct 14 (see FIG. 3). The coupler 12 generally includes a prismatic structure or connector that is sized and configured to "snap" onto the vent 18 (see FIG. 1), into the space vacated by the vent 18 (see FIG. 2), or otherwise engage the dedicated port 20 (see FIG. 3), thereby providing a fluid communication channel between the HVAC duct 14 and the dryer attachment 10. The coupler 12 may be manufactured from a polymeric material, a metallic material, or the like. Various latches, retention mechanisms, and/or locking mechanisms may be used to secure the coupler 12 onto the vent 18 (see FIG. 1), into the space vacated by the vent 18 (see FIG. 2), or into/onto the dedicated port 20 (see FIG. 3).

The dryer attachment 10 also includes a flexible conduit 22 coupled to the coupler 12. The flexible conduit 22 consists of a hose and may have any desired length such that the dryer attachment 10 may be used in a desired area inside or outside the vehicle 16, away from the coupler 12 and vent 18 or dedicated port 20. The flexible conduit 22 may be entirely flexible, or include both flexible and rigid portions. The flexible conduit 22 may be manufactured, in whole or in part, from a polymeric material, a metallic material, or the like. For example, the flexible conduit 22 may be a rubber hose, a flexible metallic conduit, an expandable "flex" hose, or the like. Such conduits and hoses are well known to those of ordinary skill in the art. Preferably, the flexible conduit 22 has an internal diameter that is sized to provide a desired air flow from the HVAC duct 14 through the dryer attachment 10, given the length of the flexible conduit 22.

At the end of the flexible conduit 22 is a nozzle 24 coupled to the flexible conduit 22 opposite the coupler 12. The coupler 12, the flexible conduit 22, and the nozzle 24 are collectively adapted to deliver an air flow from the HVAC duct 14 of the vehicle 16 to an object disposed adjacent to a port 26 of the nozzle 24. The flexible conduit 22 is coupled to the nozzle via a fluid tight seal 28, which may be any type of fluid tight seal known to those of ordinary skill in the art. The port 26 of the nozzle 24 may include a simple opening, a multiple openings, a baffled opening, a spray opening, etc. In general, the nozzle 24 may consist of a simple cylindrical structure, or a structure with a tapering inside diameter, such that the velocity of the air flow is increased as it passes through the nozzle 24, or a structure with a tapering inside diameter, such that the velocity of the air flow is decreased as it passes through the nozzle 24. The outside diameter may have any suitable shape, such as a shape that promotes gripping by the user, attachment to another structure, etc. Optionally, the nozzle 24 includes an electric fan that imparts additional velocity to the air flow there through, powered by either a battery pack or a power supply of the vehicle 16 through power cable coincident with the flexible conduit 22 and receptacle coincident with the vent 18 or dedicated port 20. The nozzle 24 may be manufactured from a polymeric material, a metallic material, or the like, and an outer surface thereof may include an appropriate gripping material, for example.

Again, as alluded to herein above, the HVAC duct 14 of the vehicle 16 is coupled to an electric air heater/cooler and blower of an HVAC system of the vehicle 16. This blower imparts velocity to the air flow that is delivered through the dryer attachment 10.

Figure 3:
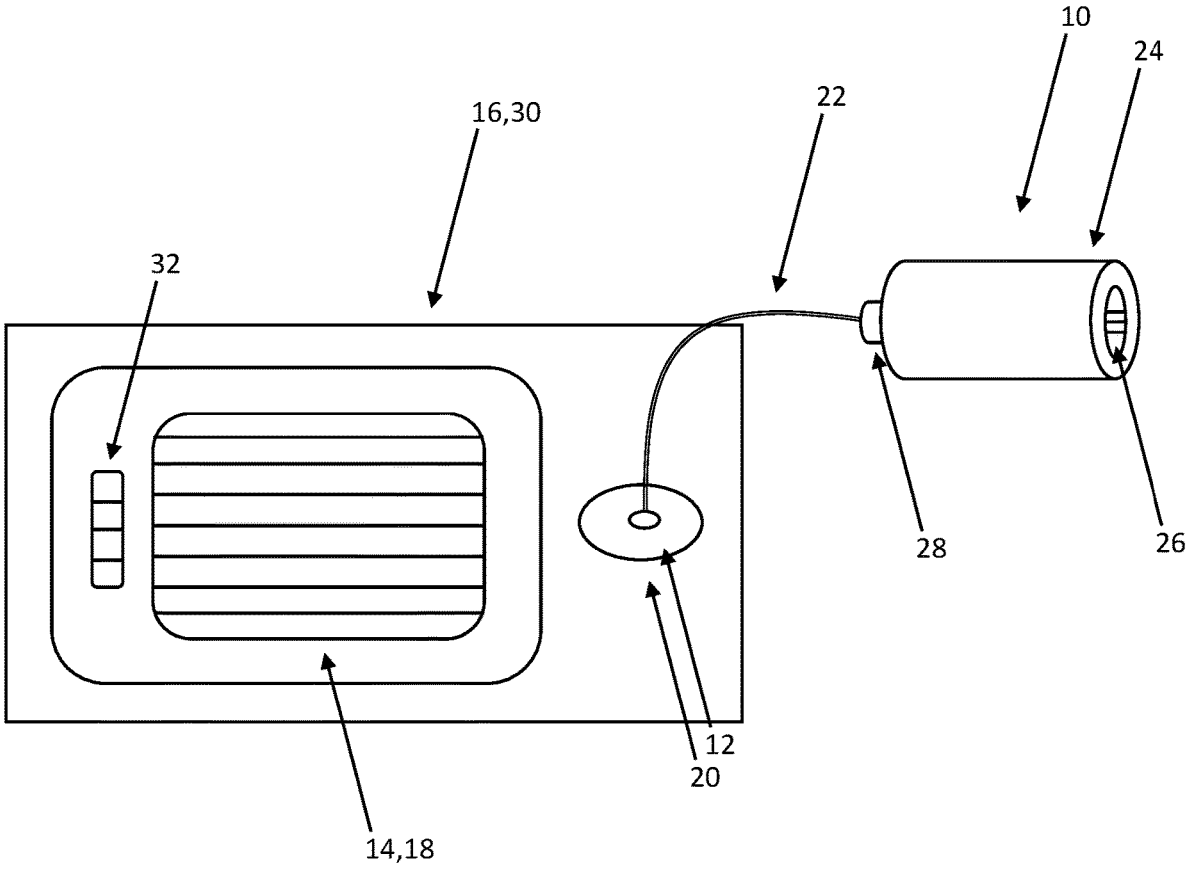
FIG. 3 is a schematic diagram illustrating a further illustrative embodiment of the dryer attachment of the present disclosure.

FIG. 3 is a schematic diagram illustrating a further illustrative embodiment of the dryer attachment 10 of the present disclosure. The dryer attachment 10 again includes a coupler 12 that is adapted to engage a HVAC duct 14 of a vehicle 16, either inside or outside the vehicle 16. Specifically, as is described in greater detail herein below, the coupler 12 is adapted to attach to a vent 18 of the HVAC duct 14 (see FIG. 1), replace the vent 18 of the HVAC duct 14 (see FIG. 2), or attach to a dedicated port 20 of the HVAC duct 14 (see FIG. 3). The coupler 12 generally includes a prismatic structure or connector that is sized and configured to "snap" onto the vent 18 (see FIG. 1), into the space vacated by the vent 18 (see FIG. 2), or otherwise engage the dedicated port 20 (see FIG. 3), thereby providing a fluid communication channel between the HVAC duct 14 and the dryer attachment 10. The coupler 12 may be manufactured from a polymeric material, a metallic material, or the like. Various latches, retention mechanisms, and/or locking mechanisms may be used to secure the coupler 12 onto the vent 18 (see FIG. 1), into the space vacated by the vent 18 (see FIG. 2), or into/onto the dedicated port 20 (see FIG. 3).

The dryer attachment 10 also includes a flexible conduit 22 coupled to the coupler 12. The flexible conduit 22 consists of a hose and may have any desired length such that the dryer attachment 10 may be used in a desired area inside or outside the vehicle 16, away from the coupler 12 and vent 18 or dedicated port 20. The flexible conduit 22 may be entirely flexible, or include both flexible and rigid portions. The flexible conduit 22 may be manufactured, in whole or in part, from a polymeric material, a metallic material, or the like. For example, the flexible conduit 22 may be a rubber hose, a flexible metallic conduit, an expandable "flex" hose, or the like. Such conduits and hoses are well known to those of ordinary skill in the art. Preferably, the flexible conduit 22 has an internal diameter that is sized to provide a desired air flow from the HVAC duct 14 through the dryer attachment 10, given the length of the flexible conduit 22.

At the end of the flexible conduit 22 is a nozzle 24 coupled to the flexible conduit 22 opposite the coupler 12. The coupler 12, the flexible conduit 22, and the nozzle 24 are collectively adapted to deliver an air flow from the HVAC duct 14 of the vehicle 16 to an object disposed adjacent to a port 26 of the nozzle 24. The flexible conduit 22 is coupled to the nozzle via a fluid tight seal 28, which may be any type of fluid tight seal known to those of ordinary skill in the art. The port 26 of the nozzle 24 may include a simple opening, a multiple openings, a baffled opening, a spray opening, etc. In general, the nozzle 24 may consist of a simple cylindrical structure, or a structure with a tapering inside diameter, such that the velocity of the air flow is increased as it passes through the nozzle 24, or a structure with a tapering inside diameter, such that the velocity of the air flow is decreased as it passes through the nozzle 24. The outside diameter may have any suitable shape, such as a shape that promotes gripping by the user, attachment to another structure, etc. Optionally, the nozzle 24 includes an electric fan that imparts additional velocity to the air flow there through, powered by either a battery pack or a power supply of the vehicle 16 through power cable coincident with the flexible conduit 22 and receptacle coincident with the vent 18 or dedicated port 20. The nozzle 24 may be manufactured from a polymeric material, a metallic material, or the like, and an outer surface thereof may include an appropriate gripping material, for example.

Again, as alluded to herein above, the HVAC duct 14 of the vehicle 16 is coupled to an electric air heater/cooler and blower of an HVAC system of the vehicle 16. This blower imparts velocity to the air flow that is delivered through the dryer attachment 10.

As illustrated in FIGS. 1-3, the HVAC duct 14, vent 18, and/or dedicated port 20 (FIG. 3) may be disposed in an instrument panel, console, or other interior or exterior surface of the vehicle 16. The nozzle 24 may ultimately be coupled to and held by a rack or other structure disposed in an interior compartment of or external to the vehicle 16, such as a drying rack upon which an object to be dried may be hung.

Optionally, enabling the air flow from the HVAC duct 14 of the vehicle 16 to the object disposed adjacent to the port 26 of the nozzle 24 includes first opening a baffle 32 of the HVAC duct 14 of the vehicle 16 adjacent to the coupler 12. Optionally, in use, the method also includes disabling another air flow from the HVAC duct 14 of the vehicle 16 by disabling the other air flow from the HVAC duct 14 of the vehicle 16 by closing a baffle of the HVAC duct 14 of the vehicle 16 remote from the coupler 12. In this manner, the air flow may be concentrated to the dryer attachment 10, if so desired. The blower of the vehicle 16 may also be run on a timer, such that a drying procedure can be carried out unattended.

Figure 4:
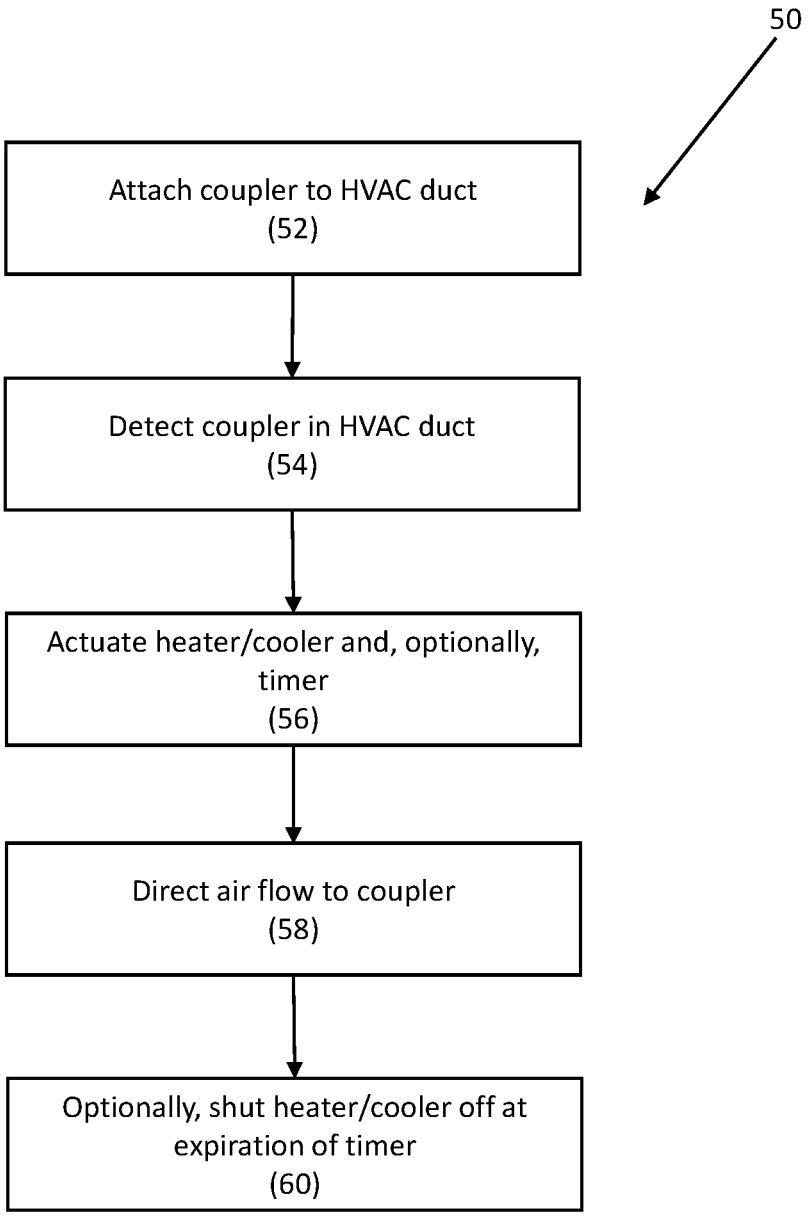
FIG. 4 is a schematic diagram illustrating a still further illustrative embodiment of the dryer attachment of the present disclosure.

FIG. 4 illustrates a method 50 for operating the dryer attachment 10 (FIGS. 1-3) of the present disclosure. Here, when the coupler 12 (FIGS. 1-3) is attached to or inserted into the HVAC duct 14/vent 18 (FIGS. 1-3) 52, the engagement of the coupler 12 is detected by the vehicle 16 (FIGS. 1-3) 54. This may be accomplished by the coupler 12 completing a circuit or triggering a switch associated with the HVAC duct 14/vent 18, for example. When the coupler 12 is detected, the heater/cooler and blower of the vehicle 16 are actuated, as optionally is a timer providing a predetermined drying cycle 56. Further, when the coupler 12 is detected, air flow may be routed primarily or exclusively to the portion of the HVAC duct 14 that is associated with the coupler 12 58, such that an adequate heated/cooled air flow is directed to the dryer attachment 10. This may be accomplished by the selectively deployment of appropriate valves or baffles within the HVAC duct system, for example. In the event that a timed drying cycle is used, the heater/cooler and blower may be shut off at the conclusion of the timed cycle 60, and air flow within the HVAC duct system may be returned to normal.

It is to be recognized that, depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently.

Thus, the present disclosure provides a dryer attachment for a vehicle that replaces a conventional plug-in hairdryer and makes use of the electric heater and HVAC duct network of the vehicle. As mentioned herein above, the electric heater utilized in the HVAC system is much more powerful than a conventional plug-in hairdryer, and operates without running a noisy and dirty IC engine. The electric heater may be set to operate for a predetermined period of time, without the vehicle otherwise operating or being drivable, thus allowing a user to go away while an object is dried, for example.

The HVAC heater/cooler and duct work of the vehicle itself are used to provide a forced air flow to an attached nozzle. A coupler plugs into or replaces a vent disposed within the interior (or on the exterior) of the vehicle, or plugs into a dedicated interior or exterior port that is in fluid communication with an HVAC duct and, ultimately the HVAC heater/cooler and associated blower. Any length of flexible (or partially flexible) conduit or hosing can be used and direct the air flow to the nozzle as needed. The HVAC system is selectively controlled to direct air flow only to a vent/port used, or may be simultaneously directed to all vents/ports to maintain overall vehicle comfort while the dryer attachment is being used. Further a rack or other support structure can be provided in or adjacent to the vehicle to hold the nozzle during a drying operation.

In some instances, one or more components may be referred to herein as "configured to," "configured by," "configurable to," "operable/operative to," "adapted/adaptable," "able to," "conformable/conformed to," etc. Those skilled in the art will recognize that such terms (for example "configured to") generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (for example, "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (for example, the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following non-limiting claims for all purposes.

What is claimed is:

1. A dryer attachment for a vehicle, comprising:

a coupler adapted to engage a heating, ventilation, and air conditioning (HVAC) duct of the vehicle;

a switch mechanism adapted to detect engagement of the coupler with the HVAC duct of the vehicle;

a flexible conduit coupled to the coupler; and a nozzle coupled to the flexible conduit opposite the coupler;

wherein the coupler, the flexible conduit, and the nozzle are collectively adapted to deliver an air flow from the HVAC duct of the vehicle to an object disposed adjacent to a port of the nozzle when the switch mechanism detects the engagement of the coupler with the HVAC duct of the vehicle.

2. The dryer attachment of claim 1, wherein the coupler is adapted to engage a vent of the HVAC duct of the vehicle.

3. The dryer attachment of claim 1, wherein the coupler is adapted to replace a vent of the HVAC duct of the vehicle.

4. The dryer attachment of claim 1, wherein the coupler is adapted to engage a dedicated port of the HVAC duct of the vehicle.

5. The dryer attachment of claim 1, wherein the flexible conduit comprises one or more flexible sections and one or more rigid sections.

6. The dryer attachment of claim 1, wherein the nozzle comprises a tapering internal diameter that decreases from an end proximate to the flexible conduit to an end distal from the flexible conduit.

7. The dryer attachment of claim 1, wherein the nozzle comprises an electric fan operable for increasing a velocity of the air flow delivered from the HVAC duct of the vehicle to the object disposed adjacent to the port of the nozzle, wherein the flexible conduit is disposed between the electric fan of the nozzle and the coupler.

8. The dryer attachment of claim 1, further comprising a rack structure adapted to hold the nozzle in a predetermined orientation with respect to the object disposed adjacent to the port of the nozzle.

9. The dryer attachment of claim 1, wherein the HVAC duct of the vehicle is coupled to an electric air heater/cooler and blower of an HVAC system.

10. A method for drying an object in a vehicle, comprising:

attaching a dryer attachment to a heating, ventilation, and air conditioning (HVAC) duct of the vehicle, wherein the dryer attachment comprises:

a coupler adapted to engage the HVAC duct of the vehicle;

a switch mechanism adapted to detect engagement of the coupler with the HVAC duct of the vehicle;

a flexible conduit coupled to the coupler; and a nozzle coupled to the flexible conduit opposite the coupler;

wherein the coupler, the flexible conduit, and the nozzle are collectively adapted to deliver an air flow from the HVAC duct of the vehicle to an object disposed adjacent to a port of the nozzle when the switch mechanism detects the engagement of the coupler with the HVAC duct of the vehicle; and enabling the air flow from the HVAC duct of the vehicle to the object disposed adjacent to the port of the nozzle.

11. The method of claim 10, wherein enabling the air flow from the HVAC duct of the vehicle to the object disposed adjacent to the port of the nozzle comprises opening a baffle of the HVAC duct of the vehicle adjacent to the coupler.

12. The method of claim 10, further comprising disabling another air flow from the HVAC duct of the vehicle.

13. The method of claim 12, wherein disabling the other air flow from the HVAC duct of the vehicle comprises closing a baffle of the HVAC duct of the vehicle remote from the coupler.

14. The method of claim 10, wherein attaching the dryer attachment to the HVAC duct of the vehicle comprises attaching the coupler to a vent of the HVAC duct of the vehicle.

15. The method of claim 10, wherein attaching the dryer attachment to the HVAC duct of the vehicle comprises replacing a vent of the HVAC duct of the vehicle with the coupler.

16. The method of claim 10, wherein attaching the dryer attachment to the HVAC duct of the vehicle comprises attaching the coupler to a dedicated port of the HVAC duct of the vehicle.

17. The method of claim 10, wherein the flexible conduit comprises one or more flexible sections and one or more rigid sections.

18. The method of claim 10, wherein the nozzle comprises a tapering internal diameter that decreases from an end proximate to the flexible conduit to an end distal from the flexible conduit.

19. The method of claim 10, wherein the nozzle comprises an electric fan operable for increasing a velocity of the air flow delivered from the HVAC duct of the vehicle to the object disposed adjacent to the port of the nozzle, wherein the flexible conduit is disposed between the electric fan of the nozzle and the coupler.

20. The method of claim 10, further comprising coupling the nozzle to a rack structure adapted to hold the nozzle in a predetermined orientation with respect to the object disposed adjacent to the port of the nozzle.

* * * * *